US007891492B2

(12) United States Patent
Wenninger et al.

(10) Patent No.: US 7,891,492 B2
(45) Date of Patent: Feb. 22, 2011

(54) PHARMACEUTICAL BLISTER CARD PACKAGE

(75) Inventors: Terrance L. Wenninger, New Washington, OH (US); Matthew S. Taylor, Shelby, OH (US); Paul D. Ricciardi, Shelby, OH (US); Michael S. Robinette, Bellville, OH (US)

(73) Assignee: Carton Service, Incorporated, Shelby, OH (US)

( * ) Notice: Subject to any disclaimer, the term of this patent is extended or adjusted under 35 U.S.C. 154(b) by 245 days.

(21) Appl. No.: 12/190,959

(22) Filed: Aug. 13, 2008

(65) Prior Publication Data

US 2009/0045094 A1 Feb. 19, 2009

Related U.S. Application Data

(60) Provisional application No. 60/955,451, filed on Aug. 13, 2007.

(51) Int. Cl.
*B65D 83/04* (2006.01)

(52) U.S. Cl. ..... 206/531; 206/469

(58) Field of Classification Search ..... 206/531, 206/532, 534, 534.1, 539, 469; 229/81
See application file for complete search history.

(56) References Cited

U.S. PATENT DOCUMENTS 3,520,469 A * 7/1970 Marx ..... 383/205
5,082,113 A * 1/1992 Romick ..... 206/459.1
5,110,007 A * 5/1992 Law et al. ..... 221/25
6,412,636 B1 * 7/2002 Jones et al. ..... 206/532
6,659,280 B2 * 12/2003 Paliotta et al. ..... 206/531
6,848,580 B2 * 2/2005 Paliotta et al. ..... 206/531
6,913,149 B2 7/2005 Gelardi
6,951,282 B2 * 10/2005 Jones ..... 206/469
6,951,353 B2 10/2005 Kozlowski
7,017,513 B2 3/2006 Giewercer
7,030,157 B2 4/2006 Ke
7,048,141 B2 5/2006 Abdulhay
7,063,211 B2 6/2006 Williams-Hartman
7,138,405 B2 11/2006 Wyllie
7,144,635 B2 12/2006 Hawes
7,188,728 B2 3/2007 Williams-Hartman
7,201,274 B2 4/2007 Paliotta
7,213,721 B2 5/2007 Abdulhay
7,243,798 B2 7/2007 Buss
7,263,947 B2 9/2007 Giewercer (Continued)

*Primary Examiner*—Ehud Gartenberg
*Assistant Examiner*—Ernesto A Grano
(74) *Attorney, Agent, or Firm*—Buckingham, Doolittle & Burroughs, LLP

(57) ABSTRACT

A pharmaceutical child-resistant fold-over card package with secure, sealed edges having: front, middle and rear panels of non-tear-resistant conventional card stock; at least one hole in such front panel, and at least one formed blister with a closed portion and an open portion, and a thin sheet of material covering such open portion of such blister to retain the position of such preparation inside such blister. A first set of perforation lines in such card along and approximately one quarter inch inside of each outside exposed perimeter edge of each such panel; a set of perforated holes in middle panel aligned with such hole in such top panel; a second set of perforation lines in the interior of such middle and rear panels and surrounding the area under the at least one blister, to form a perforated window under such blister and to form a tear tab.

10 Claims, 2 Drawing Sheets

U.S. PATENT DOCUMENTS 7,325,689 B2 2/2008 Buss
7,334,379 B1 2/2008 Siegel
7,337,906 B2 3/2008 Chang
7,377,394 B2 5/2008 Buss
7,387,206 B2 6/2008 Grosskopf

* cited by examiner

PHARMACEUTICAL BLISTER CARD PACKAGE

This utility patent application claims priority to provisional patent application Ser. No. 60/955,451 titled "Pharmaceutical Blister Card Package" having a filing date of Aug. 13, 2007. The subject matter of provisional patent application Ser. No. 60/955,451 is hereby incorporated by reference.

The present invention relates to the art of pharmaceutical packaging. More particularly, the invention relates to the art of pharmaceutical blister card packaging, which is packaging that includes a paperboard fold-over card containing thermoformed or cold formed blisters which hold tablets, capsules and gel capsules. Still more particularly, the invention relates to a cost-effective and convenient pharmaceutical blister card package that is child resistant, yet easy to use for senior adults.

THE PRIOR ART

As mentioned above, a pharmaceutical blister card package typically includes a paperboard fold-over card which contains a thermoformed or cold formed blister, which is referred to herein as a formed blister or a blister. The card provides robustness for structural stability of the package, while each formed blister protects and contains a pharmaceutical preparation such as a tablet, capsule or gel capsule (hereinafter collectively referred to as tablets for the purpose of convenience). When a user needs to take a tablet, he or she presses a selected blister, and the tablet contained in that blister breaks through a foil or paper backing or insert in the card In the pharmaceutical packaging art, it is desirable for such blister card packaging to be both child resistant and easy to use by senior adults. That is, it is desirable to provide a package that prevents young children from being able to easily open it and thus access a tablet. At the same time, it is also desirable to provide a package that enables senior adults, who may suffer from arthritis or other conditions, to relatively easily open the package and access a tablet. Criteria for child resistance and ease of use by senior adults of pharmaceutical packaging are established by the Consumer Product Safety Commission ("CPSC"), and are set forth in the U S Code of Federal Regulations ("CFR") at 16 CFR §1700. These Regulations specify tests that are performed on pharmaceutical packaging, and the results of these tests correspond to an assigned level of child resistance and senior friendliness. These levels are known in the art as an F-1, F-2, or F-3 status. A pharmaceutical package that achieves F-1 status adheres to the most stringent requirements for child resistance and senior friendliness, while a pharmaceutical package that achieves an F-3 status adheres to the least stringent requirements for child resistance and senior friendliness. Of course, it is desirable for a pharmaceutical package to achieve an F-1 status of child resistance and senior friendliness.

In the pharmaceutical blister card packaging art, there are package designs that have achieved an F-1 status, but these designs possess certain disadvantages, such as an undesirably high cost and an undesirable lack of consistency. More particularly, the F-1 status blister card packages of the prior art include fold-over cards that use a specialty paperboard, such as tear-resistant paperboard, and/or separately applied adhesive labels to trap and protect the blister containing the tablet. Such construction of prior-art blister card packages has led to disadvantages associated with material availability, label management, and cost.

Turning first to material availability, tear-resistant paper board is considered a non-standard, specialty paperboard that is manufactured by only a few paperboard mills in the United States. Since paperboard mills experience a significant cost to transition their mills from one type of board to another, the mills have established a minimum production volume of a particular paperboard grade or type in order to offset such costs. Thus, before a mill can manufacture tear-resistant paperboard, the mill must let orders from customers "build up" to the minimum production volume. The time required for such a build up creates an unpredictable lead time to obtain tear-resistant paperboard, which may be as short as 6 weeks, or as long as 12 weeks. Such variability in lead time makes it difficult for pharmaceutical companies and/or pharmaceutical packaging companies to efficiently plan their production schedules, and particularly to meet increased production forecasts.

In an attempt to reduce the problems created by such unpredictable material availability, pharmaceutical companies and/or pharmaceutical packaging companies have held tear-resistant paperboard in inventory. Since tear-resistant paperboard is expensive, and a large amount of the paperboard must be purchased for inventory, this solution creates a significant cash drain which is economically undesirable. In addition, the potential for the paperboard to be damaged while it is held in inventory, and the unpredictability of the correct size of the paperboard to buy for future production, add to the undesirability of storing the paperboard in inventory.

Label management is a second disadvantage of prior-art blister card packages. In the prior art, the labels that are applied to a tear-resistant fold-over card are adhesive labels. Adhesive labels include an undesirably high cost, which may be from about 25% to about 60% of the total package cost, depending on the number of labels used, the specific type of labels, and how the labels are applied. The factors that lead to such a high cost for labels include the cost of label stock, which is significantly higher than paperboard because it is of a higher mill quality. In addition, the production of adhesive labels must be performed on separate and unique equipment to facilitate the application of the adhesive onto the label, and the adhesive requires distinctive methods in order to handle and store it, all of which add to the cost of producing an adhesive label.

Prior art adhesive labels may also include a lack of consistency, adding to the disadvantages associated with label management. For example, since the labels typically are produced in a printing and die cutting process that is separate from production of the tear-resistant paperboard, it is possible that the colors printed on the label may undesirably not match the colors printed on the tear-resistant paperboard. Pharmaceutical companies and/or pharmaceutical packaging companies have attempted to address this lack of consistency by either not printing information on the label, or printing the labels in a color that is not used on the carton. Moreover, the application of the labels to the blister card packaging requires a separate production process, which adds more cost to the packaging and requires verification of the labels in order to ensure that they have been applied in the correct position on the packaging. This verification is an additional quality check that increases the cost of the packaging. In addition, other costly and therefore undesirable quality checks are associated with label management for adhesive labels, such as quality checks on the adhesive, which must be performed to ensure that the adhesive being used on the label is being applied in conformance with predetermined specifications.

For prior art blister card packaging, undesirably high cost is a third disadvantage. More particularly, prior art blister card packaging that has achieved F-1 status typically employs a tear-resistant fold-over card, and the cost of the tear-resistant paperboard used for the card significantly increases the cost of the packaging. For example, the cost of tear-resistant paperboard is approximately 40% higher than standard virgin fiber paperboard. In addition, the paperboard mills typically impose minimum volumes for a purchase of tear-resistant paperboard, such as at least 40,000 pounds, while such minimum volumes are not required for other forms of paperboard. Thus, the use of tear-resistant paperboard creates significant undesirable costs for pharmaceutical companies and/or pharmaceutical packaging companies. Moreover, as described above, if adhesive labels are used, the costs associated with such labels drives the cost of prior art blister card packaging even higher. Such undesirable costs may leave a small-to-medium sized pharmaceutical company without a cost-effective package that has F-1 status.

As a result, a need has existed in the art to develop a pharmaceutical blister card package that overcomes the disadvantages of the prior art by providing a package with a paperboard fold-over card and a formed blister, while having F-1 status and the ability to be manufactured more economically and with more consistency than prior art packages. The pharmaceutical blister card package of the present invention satisfies this need.

SUMMARY OF THE INVENTION

An embodiment is directed to a pharmaceutical child-resistant fold-over card package with secure, sealed edges having: front, middle and rear panels of non-tear-resistant conventional card stock, each panel having a top and a bottom side, aligned in a stack with each top side facing in the same direction; at least one hole in such front panel, and at least one formed blister with a closed portion and an open portion, protruding through such top panel and away from the middle and bottom panels, a pharmaceutical preparation inside of such blister, and a thin sheet of material covering such open portion of such blister to retain the position of such preparation inside such blister; a first set of perforation lines in such card along and approximately one quarter inch inside of each outside exposed perimeter edge of each such panel; a set of perforated holes in middle panel aligned with such hole in such top panel such holes having the geometric shape of such preparation, the size of such hole in the top panel being such that such preparation narrowly passes through such hole, and such hole in the middle panel being smaller in size than such hole in such top panel; a second set of perforation lines in the interior of such middle and rear panels and surrounding the area under the at least one blister, to form a perforated window under such blister and to form a tear tab adjacent to and outside of such perforated window; adhesive tear strips affixed to the bottom of the middle panel aligned with such tear tabs and crossing such perforated window area; and adhesive material that straddles such first set of perforation lines, and other adhesive material outside of such perforated window area, on the bottom side of the front panel and the top side of the rear panel, so such top, middle, and rear panels are affixedly aligned, so that the package is securely assembled and so that any tear of any exposed edge of such card is interrupted at any of such first set of perforation lines, and so that access to such capsule can be achieved by peeling a desired tab, tearing away the adjacent perforated window, and pressing a desired capsule or group of capsules through the foil and out such window by exerting pressure on the blister from the top side of the front panel.

Another embodiment is directed to a pharmaceutical child-resistant fold-over card package with secure, sealed edges having: front, middle and rear panels of non-tear-resistant conventional card stock, each panel having a top and a bottom side, aligned in a stack with each top side facing in the same direction; at least one hole in such front panel, and at least one formed blister with a closed portion and an open portion, protruding through such top panel and away from the middle and bottom panels, a pharmaceutical preparation inside of such blister, and a thin sheet of material covering such open portion of such blister to retain the position of such preparation inside such blister; a first set of perforation lines in such card along and approximately one quarter inch inside of each outside exposed perimeter edge of each such panel; a second set of perforation lines in the interior of such middle and rear panels and surrounding the area under the at least one blister, to form a perforated window under such blister and to form a tear tab adjacent to and outside of such perforated window; adhesive tear strips affixed to the bottom of the middle panel aligned with such tear tabs and crossing such perforated window area; and adhesive material that straddles such first set of perforation lines, and other adhesive material outside of such perforated window area, on the bottom side of the front panel and the top side of the rear panel, so such top, middle, and rear panels are affixedly aligned, so that the package is securely assembled and so that any tear of any exposed edge of such card is interrupted at any of such first set of perforation lines, and so that access to such capsule can be achieved by peeling a desired tab, tearing away the adjacent perforated window, and pressing a desired capsule or group of capsules through the foil and out such window by exerting pressure on the blister from the top side of the front panel.

Another embodiment is directed to a method of making a pharmaceutical child-resistant fold-over card package, with secure, sealed edges, suitable for holding and allowing access to at least one pharmaceutical preparation such as a capsule, having the steps: die-cutting a rectangular card from non-tear-resistant conventional paperboard cardstock, having two parallel fold lines forming a first end, a second middle and a third end panel of approximately equal length or width, and such card having a first and second side, die-cutting at least one hole in such middle panel; pressing a sheet of plastic having at least one formed blister against the second side of such middle panel so that the at least one blister protrudes through such hole; placing a pharmaceutical preparation in such blister; pressing a thin film of material over such sheet of plastic; making a first set of perforation lines in such card along and approximately one quarter inch inside of the outside perimeter edge of the sides of such card perpendicular to such fold line, and of the outside perimeter edge of such first panel; die-cutting in such third panel at least one perforated hole having the geometric shape of such pharmaceutical preparation and being smaller in size than and positioned to align with such hole in such middle panel; making a second set of perforation lines in the interior of such first end panel positioned to surround the area under the at least one blister, and forming a perforated window and a tear tab adjacent to and outside of such perforated window; affixing adhesive tear strips to the first side of such third end panel and aligned with such tear tabs; applying adhesive material that straddles such first set of perforation lines on the second side of such first end and second middle panel, and other adhesive material outside of such perforated window area to second side of the first end and second middle panels and straddling the fold line between such panels; folding the third end panel along its adjacent fold line to align with the middle panel, and folding the first panel along its adjacent fold line to align with the third end and second middle panels, so that so that after such folding such middle, first, and third panels are affixedly aligned, so that the package is securely assembled and so that any tear of any exposed edge of such card is interrupted at any of such first set of perforation lines, and so that access to such capsule can be achieved by peeling a desired tab, tearing away the adjacent perforated window, and pressing a desired capsule or group of capsules through the foil and out such window by exerting pressure on the blister from the top side of the front layer.

Another embodiment is directed to a method of making a pharmaceutical child-resistant fold-over card package, with secure, sealed edges, suitable for holding and allowing access to at least one pharmaceutical preparation such as a capsule, comprising: die-cutting a rectangular card from non-tear-resistant conventional paperboard cardstock, having two parallel fold lines forming a first end, a second middle and a third end panel of approximately equal length or width, and such card having a first and second side, die-cutting at least one hole in such middle panel; pressing a sheet of plastic having at least one formed blister against the second side of such middle panel so that the at least one blister protrudes through such hole; placing a pharmaceutical preparation in such blister; pressing a thin film of material over such sheet of plastic; making a first set of perforation lines in such card along and approximately one quarter inch inside of the outside perimeter edge of the sides of such card perpendicular to such fold line, and of the outside perimeter edge of such first panel; making a second set of perforation lines in the interior of such first and third end panels positioned to surround the area under the at least one blister, and forming a perforated window and a tear tab adjacent to and outside of such perforated window; affixing adhesive tear ships to the first side of such third end panel and aligned with such tear tabs; applying adhesive material that straddles such first set of perforation lines on the second side of such first end and second middle panel, and other adhesive material outside of such perforated window area to second side of the first end and second middle panels and straddling the fold line between such panels; folding the third end panel along its adjacent fold line to align with the middle panel, and folding the first panel along its adjacent fold line to align with the third end and second middle panels, so that so that after such folding such middle, first, and third panels are affixedly aligned, so that the package is securely assembled and so that any tear of any exposed edge of such card is interrupted at any of such first set of perforation lines, and so that access to such capsule can be achieved by peeling a desired tab, tearing away the adjacent perforated window, and pressing a desired capsule or group of capsules through the foil and out such window by exerting pressure on the blister from the top side of the front layer.

DETAILED DESCRIPTION

The preferred embodiment of the invention, illustrative of the best mode in which applicants have contemplated applying the principles of the invention, is set forth in the following description and is shown in the drawings.

Similar numerals refer to similar parts throughout the drawings.

Figure 1:
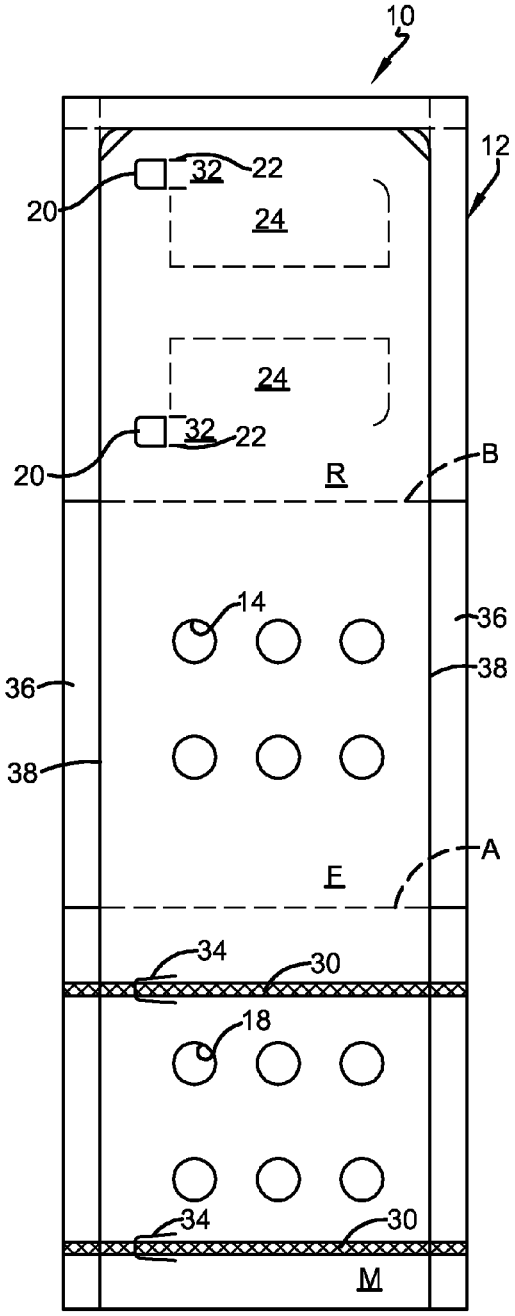
FIG. 1 is a plan view of the front side of an exemplary embodiment of a pharmaceutical blister card package of the present invention, after cutting of the paperboard and before the application of adhesive and formed blister.

Turning now to the drawings of the present invention, wherein the illustrations are for showing preferred embodiments of the invention, and not for limiting the same, FIGS. 1-4 show an exemplary embodiment of a pharmaceutical blister card package of the present invention, indicated generally at 10. With particular reference to FIG. 1, blister card package 10 includes a paperboard fold-over card 12 that preferably is made of standard paperboard, such as virgin fiber paperboard. Card 12 includes a front panel F, a middle panel M, and a rear panel R. Holes 14 are formed in front panel F and correspond to tablets 16 (FIG. 3) that are contained by package 10, as will be described below. Thus, in the illustrated embodiment, six holes 14 are formed to correspond to six tablets 16. Holes 14, as with all of the features formed in card 12, preferably are formed by die cutting.

Holes 18 are formed in middle panel M of card 12, and correspond to holes 14 formed in front panel F, but are of a slightly smaller size than the holes formed in the front panel, in order to retain the position of tablets 16, as will be described in greater detail below. Rear panel R is formed with tabs 20 adjacent respective perforated lines 22 and respective perforated windows 24. Middle panel M is formed with tabs 34 that correspond to rear panel tabs 20. The operation of tabs 20, 34, perforated lines 22 and perforated windows 24 will also be described in greater detail below. It is to be understood that holes 14 and holes 18, while shown as round openings, may be other geometric shapes, such as oval or square openings.

During manufacturing, a sheet of plastic, preferably made of clear polyvinyl chloride ("PVC") and having thermoformed or cold formed blisters 26 (FIG. 3), is pressed against the bottom surface of front panel F, so that the blisters extend through front panel holes 14. Blisters 26 can be applied to card 12 either manually or by a machine, depending on specific processing considerations. Tablets 16 are then placed in blisters 26 from the bottom surface of front panel F and a foil or paper backing 28 (FIG. 3), preferably a heat-sealable aluminum foil, is pressed against the PVC sheet and sealed to the sheet, as known in the art, to seal the tablets in the blisters. A strip of pressure sensitive tape 30, such as tensilized polypropylene teartape with a rubber adhesive, is applied to middle panel M from each tab 34 across the middle panel, which corresponds to an area 32 on rear panel R that is located between each respective perforated line 22 and perforated window 24.

Figure 2:
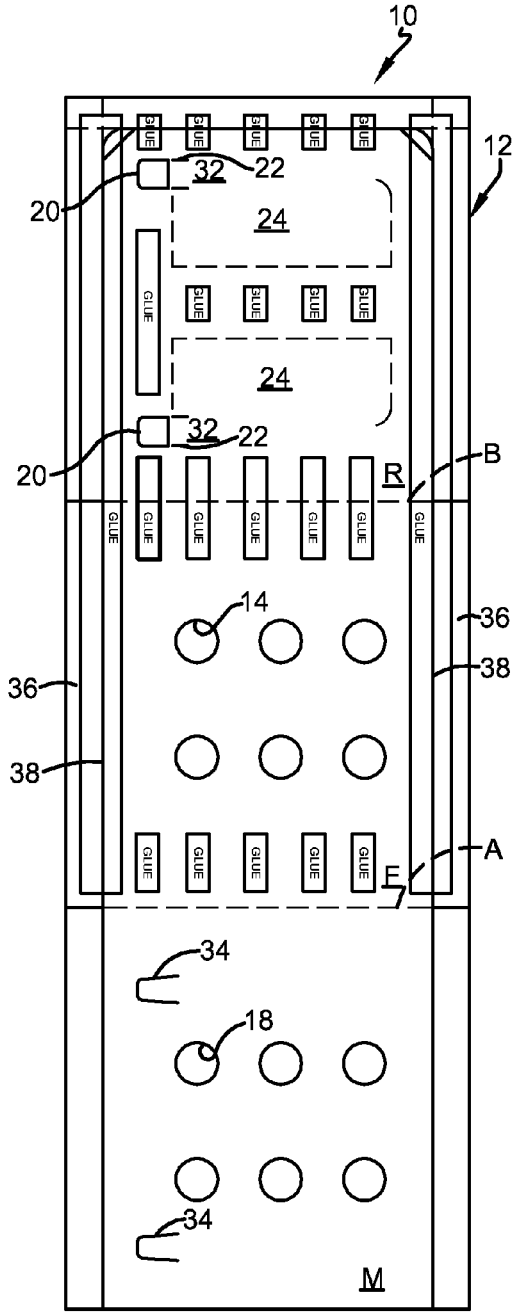
FIG. 2 is a plan view of the back or rear side of the embodiment of the invention shown in FIG. 1, after the application of adhesive.

With reference now to FIG. 2, adhesive means, such as pressure sensitive tape or a hot melt adhesive, is applied to the bottom surface of front panel F and rear panel R in areas designated as "Glue". Middle panel M is then folded along line A, which causes middle panel holes 18 to align with front panel holes 14, and the adhesive on front panel F causes the front and middle panels to adhere to one another in alignment. Rear panel R is then folded along line B, and the adhesive on the rear panel causes the rear panel to adhere to middle panel M in an aligned manner. Once adhered to middle panel M, each perforated window 24 formed in rear panel R aligns with holes 18 formed in the middle panel and with holes 14 formed in front panel F Also, once rear panel R is adhered to middle panel M, rear panel tabs 20 align with middle panel tabs 34, and area 32 on the rear panel aligns with tape 30 on the middle panel.

Figure 4:
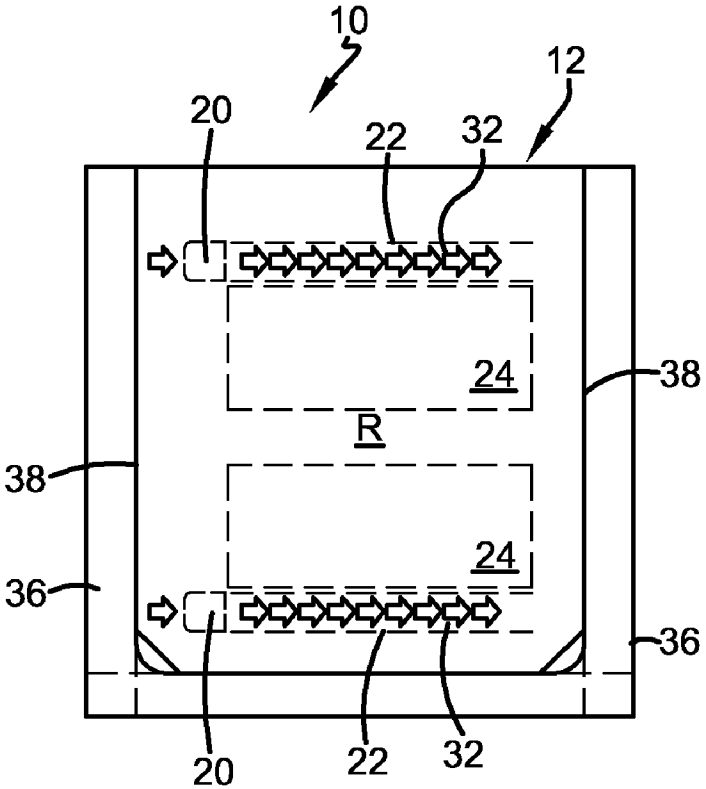
FIG. 4 is a photograph of the rear panel of the embodiment of the invention shown in FIG. 3.
Figure 3:
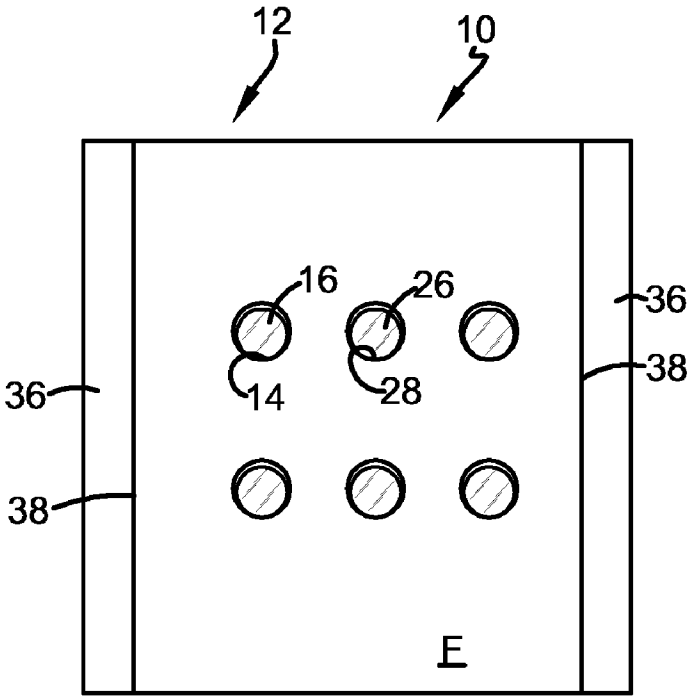
FIG. 3 is a photograph of the front panel of the embodiment of the invention shown in FIG. 2, after assembly and folding

Turning now to FIGS. 3 and 4, the folded package 10 is shown. Blisters 26 protrude through holes 14 formed in front panel F, and instructions are printed directly on card 12. To access tablets 16, a user grasps a selected one of tabs 20 and pulls. Tape 30 (FIG. 1), which is aligned with selected tab 20, causes area 32 to pull away from card 12 when the tab is pulled, thereby reducing the strength of rear panel R and enabling tablets 16 to be pressed from blisters 26 through perforated windows 24. That is, while tape 30 is still in place on card 12, rear panel R maintains enough strength to generally prevent tablets 16 from being pressed though perforated windows 24. However, when tab 20 is pulled, tape 30 causes area 32 to be removed so that tablets 16 can be pressed through window 24.

Package 10 also includes a secure seal edge 36. In the prior art, blister card packages using fold-over cards had to employ expensive adhesive security labels to eliminate the possibility of a child gaining entry into the package and to the tablets by splitting the edge of the fold-over card. Secure seal edge 36 prevents such entry without expensive adhesive labels. More particularly, with reference to FIGS. 1 and 2, card 12 is formed with perforated lines 38 approximately one quarter of an inch inside the outer edge of the card. Two of the "Glue" areas, as shown in FIG. 2, are along lines 38 of front panel F and rear panel R. In use, if a child attempts to tear into package 10 along the edge of card 12, perforated line 38 will tear, leaving the adhesive on the very edge of the card. This significantly reduces the child's ability to gain access through the edge of card 12.

The use of secure seal edge 36 is important to note because it is not possible to apply adhesives known in the art to the extreme edge of card 12, thus leaving an opportunity for a child to gain access by leveraging the strengths of the paperboard to pull apart the card. By using secure seal edge 36, package 10 effectively has adhesive to the outer edge of card 12, and thus eliminates the need to use expensive adhesive security labels.

Package 10 of the present invention has undergone testing, and has achieved F-1 status in conformance with 16 CFR §1700. Thus, the unique design and construction of package 10 provides a child-resistant and senior-friendly blister card package using fold-over card 12, which is economical to manufacture.

By using card 12 made of virgin fiber paperboard and formed blisters 26, which are readily available in the marketplace, the cost of the base materials has been reduced by at least 40% when compared to prior art blister card packages with tear-resistant paperboard fold-over cards. Moreover, with the elimination of special or custom made materials, such as tear-resistant paperboard, lead times are reduced and the ready availability of standard virgin fiber paperboard eliminates the material availability problems and minimum purchase quota problems of the prior art. In addition, virgin paperboard is a recyclable material, thus reducing solid waste problems associated with the non-recyclable material of the prior art.

The elimination of a separately applied adhesive label or labels in package 10 with F-1 status reduces the cost of the package and improves the consistency and quality of the package. In addition, the design and construction of package 10 enables most of the manufacturing of the package to occur in-line through one production process, rather than many separate processes. The cost effectiveness of package 10 of the present invention enables small to mid-sized pharmaceutical companies or low volume users to have an F-1 status blister card package, and thus provide high-quality packaging for their products at competitive costs.

While package 10 is shown and described above as a six-cavity package, the package of the present invention may employ any number of cavities, such as from 1 cavity to 60, without affecting the overall concept or operation of the invention. Of course, alternative configurations for holes 14, 18, windows 24 and tabs 20 may also be used without affecting the overall concept or operation of the invention. Package 10 of the present invention may also be designed to accommodate auto-fill equipment, in which case the package will continue to utilize the same basic design and production processes, with minor variations to adhere to machine and processing specifications. Moreover, although originally designed for application in the pharmaceutical industry, the features of package 10 of the present invention may find application in other industries as well.

The present invention has been described with reference to a specific embodiment. It is understood that this description and illustration is by way of example and not by way of limitation. Potential modifications and alterations will occur to others upon a reading and understanding of this disclosure, and it is understood that the invention includes all such modifications and alterations and equivalents thereof.

What is claimed is:

1. A pharmaceutical child-resistant fold-over card package with secure, sealed edges comprising:

a front panel, a middle panel and a rear panel of non-tear-resistant conventional card stock, each panel having a top side and a bottom side, aligned in a stack with each top side facing in the same direction;

at least one hole in the front panel, and at least one formed blister with a closed portion and an open portion, protruding through the front panel and away from the middle panel and the rear panel, a pharmaceutical preparation inside of the at least one blister, and a thin sheet of material covering the open portion of the at least one blister to retain a position of the preparation inside the at least one blister;

a first set of perforation lines along and approximately one quarter inch inside of each outside exposed perimeter edge of each of the front panel, the middle panel and the rear panel;

a set of perforated holes in the middle panel aligned with the at least one hole in the front panel, the at least one holes having the geometric shape of the preparation, the size of the at least one hole in the front panel being that the preparation narrowly passes through the at least one hole, and the at least one hole in the middle panel being smaller in size than the one of the perforated holes in the front panel;

a second set of perforation lines in an interior of the middle panel and the rear panel and surrounding an area under the at least one blister, to form a perforated window under the at least one blister and to form a tear tab adjacent to and outside of the perforated window;

adhesive tear strips affixed to the bottom side of the middle panel aligned with the tear tab and crossing the perforated window area; and adhesive material that straddles the first set of perforation lines, and another adhesive material outside of the perforated window area, on the bottom side of the front panel and the top side of the rear panel, so the front panel, the middle panel, and the rear panel are affixedly aligned, so that the package is securely assembled and so that any tear of any exposed edge of the front panel, middle panel and rear panel is interrupted at any of the first set of perforation lines, and so that access to a capsule can be achieved by peeling the tear tab, tearing away the adjacent perforated window, and pressing the capsule or a group of capsules through said thin sheet and out the perforated window by exerting pressure on the at least one blister from the top side of the front panel.

2. The package of claim 1 wherein the first set of perforation lines is along and approximately three-eights of an inch inside of each of the outside perimeter edge of the front panel, the middle panel and the rear panel.

3. The package of claim 1 wherein the thin sheet of material is aluminum foil.

4. The package of claim 1 wherein the thin sheet of material is paper.

5. The package of claim 1 wherein the adhesive tear strips are comprised of tensilized polypropylene teartape.

6. A pharmaceutical child-resistant fold-over card package with secure, sealed edges comprising:

a front panel, a middle panel and a rear panel of non-tear-resistant conventional card stock, each panel having a top side and a bottom side, aligned in a stack with each top side facing in the same direction;

at least one hole in the front panel, and at least one formed blister with a closed portion and an open portion, protruding through the front panel and away from the middle panel and the rear panel, a pharmaceutical preparation inside of the at least one blister, and a thin sheet of material covering the open portion of the at least one blister to retain a position of the preparation inside the at least one blister;

a first set of perforation lines along and approximately one quarter inch inside of each outside exposed perimeter edge of each of the front panel, the middle panel and the rear panel;

a second set of perforation lines in an interior of the middle panel and the rear panel and surrounding an area under the at least one blister, to form a perforated window under the at least one blister and to form a tear tab adjacent to and outside of the perforated window;

adhesive tear strips affixed to the bottom side of the middle panel aligned with the tear tab and crossing the perforated window area; and adhesive material that straddles the first set of perforation lines, and another adhesive material outside of the perforated window area, on the bottom side of the front panel and the top side of the rear panel, so the front panel, the middle panel, and the rear panel are affixedly aligned, so that the package is securely assembled and so that any tear of any exposed edge of the front panel, middle panel and rear panel is interrupted at any of the first set of perforation lines, and so that access to a capsule can be achieved by peeling the tear tab, tearing away the adjacent perforated window, and pressing the capsule or a group of capsules through said thin sheet and out the perforated window by exerting pressure on the at least one blister from the top side of the front panel.

7. The package of claim 6 wherein the first set of perforation lines is along and approximately three-eights of an inch inside of each of the outside perimeter edge of the front panel, the middle panel and the rear panel.

8. The package of claim 6 wherein the thin sheet of material is aluminum foil.

9. The package of claim 6 wherein the thin sheet of material is paper.

10. The package of claim 6 wherein the adhesive tear strips are comprised of tensilized polypropylene teartape.

* * * * *